US005901569A

United States Patent [19]

Sin

[11] Patent Number: 5,901,569

[45] **Date of Patent: *May 11, 1999**

[54] REFRIGERATOR

[75] Inventor: Jun-Chul Sin, Incheon, Rep. of Korea

[73] Assignee: Daewoo Electronics Co., Ltd., Seoul, Rep. of Korea

[ * ] Notice: This patent is subject to a terminal disclaimer.

[21] Appl. No.: 08/989,405

[22] Filed: Dec. 12, 1997

[30] Foreign Application Priority Data

Jun. 30, 1997 [KR] Rep. of Korea ..... 97-28966

[51] Int. Cl.[6] ..... F25D 17/04

[52] U.S. Cl. ..... 62/407; 62/515; 165/122; 416/113; 416/150

[58] Field of Search ..... 62/407, 408, 440, 62/515; 416/108, 109, 113, 116, 150; 165/122, 163, 181

[56] References Cited

U.S. PATENT DOCUMENTS 5,193,359 3/1993 Martin et al. .
5,214,938 6/1993 Kennedy et al. .

*Primary Examiner*—William Doerrler
*Attorney, Agent, or Firm*—Cushman Darby & Cushman IP Group of Pillsbury Madison & Sutro LLP

[57] ABSTRACT

A refrigerator having an improved fan which blows air towards a heat exchanger such as an evaporator. The refrigerator has a body having a refrigerating chamber, a freezing chamber, and a chilled air passage which communicates with the refrigerating and freezing chambers. An evaporator for generating a chilled air by heat-exchanging with an air is installed in the body. The evaporator has a spiral-shaped refrigerant pipe which is disposed in a longitudinal direction of the chilled air passage, and a plurality of heat exchange pins disposed around the spiral-shaped refrigerant pipe, for increasing a heat exchange area between the air and the spiral-shaped refrigerant pipe. A fan for blowing the air toward the evaporator and for circulating the chilled air into the refrigerating is installed in the chilled air passage. A motor is fixed to a wall of the body forming the chilled air passage. The fan can be reciprocated towards the evaporator, so a blowing force applied to the evaporator is varied by a reciprocating movement of the fan so that an air flow formed from the fan to the evaporator is changed to a turbulent air flow. The refrigerator does not make a heat boundary layer, so the heat exchange efficiency is improved.

10 Claims, 6 Drawing Sheets

REFRIGERATOR

BACKGROUND OF THE INVENTION

1. Field of the Invention

The present invention relates to a refrigerator, and more particularly to a refrigerator having an improved fan which blows air towards a heat exchanger, such as an evaporator, in order to permit chilled air to circulate in the refrigerator.

2. Prior Arts

Generally, a refrigerator has an evaporator for generating chilled air and a fan which blows air towards the evaporator and circulates the chilled air into a refrigerating chamber and a freezing chamber through ducts.

FIG. 1 is a side sectional view of a conventional refrigerator 100 having a fan 141 therein.

As shown in FIG. 1, refrigerator 100 has a body 110 having a refrigerating chamber 111 and a freezing chamber 112 therein, and a door 120 rotatably attached to the front of body 110. An air passage 117 which is communicated with both refrigerating chamber 111 and freezing chamber 112 is formed in both a partition wall 115 which separates refrigerating chamber 111 from freezing chamber 112 and a rear wall 116. An evaporator 131 which receives a low-pressure and low-temperature refrigerant from a condenser (not shown), which is disposed in a machine room 150 so as to make chilled air, is installed in air passage 117. In addition, fan 141 for blowing air towards evaporator 131 and a motor 142 for driving fan 141 are also installed in air passage 117. Fan 141 circulates chilled air into refrigerating chamber 111 and freezing chamber 112 through ducts. Reference numeral 135 indicates a compressor for compressing the refrigerant so that the refrigerant has a high-temperature and a high-pressure.

The fan having the above structure is fixed to a wall of the body which forms the air passage. Particularly, the motor is fixed to a rear wall of the refrigerator and the fan is connected to a motor shaft so as to be rotated. At this time, the fan does not linearly move in the axis direction of the motor.

However, the conventional refrigerator has disadvantages that a heat boundary layer is formed on the evaporator while air blown by the fan is heat-exchanged with the evaporator if the blowing force of the fan is constant. As a result, the heat-exchange efficiency is reduced due to the heat boundary layer.

On the other hand, U.S. patent application Ser. No. 5,193,359 issued to Jerry C. Martin discloses a fan which blows air into an evaporator chamber in a refrigerator. However, Martin's fan also forms the heat boundary layer on an evaporator, so the heat-exchange efficiency is reduced.

In addition, U.S. patent application Ser. No. 5,214,938 issued to Adam C. Kennedy also discloses a fan which blows air into an evaporator chamber in a refrigerator. However, Kennedy's fan also forms the heat boundary layer on an evaporator, thereby causing the problem mentioned above.

SUMMARY OF THE INVENTION

The present invention has been made to overcome the above described problem of the prior art, and accordingly, it is an object of the present invention to provide a refrigerator in which a fan is reciprocated in the axis direction of a motor so that a blowing force of the fan varies and a turbulent air flow is generated by the fan, thereby improving the heat-exchange efficiency.

To achieve the above object, the present invention provides a refrigerator comprising: a body having a refrigerating chamber, a freezing chamber, and a chilled air passage which communicates with the refrigerating and freezing chambers; an evaporator for generating a chilled air by heat-exchanging with an air, the evaporator having a spiral-shaped refrigerant pipe which is disposed in a longitudinal direction of the chilled air passage, and a plurality of heat exchange pins disposed around the spiral-shaped refrigerant pipe for increasing a heat exchange area between the air and the spiral-shaped refrigerant pipe; a first means for blowing the air toward the evaporator and for circulating the chilled air into the refrigerating and freezing chambers, the first means being installed in the chilled air passage; a second means for driving the first means; and a third means for reciprocating the first means towards the evaporator in which a blowing force applied to the evaporator being varied by a reciprocating movement of the first means so that an air flow from the first means to the evaporator is changed to a turbulent air flow.

According to the preferred embodiment of the present invention, the first means includes a fan and the second means includes a motor. The fan has a hub and blades integrally formed at a circumference of the hub, for blowing the air in an axis direction of the motor. The hub is rotatably coupled to a shaft of the motor in such a manner that the hub linearly moves along the shaft of the motor. The hub has an inclined underside.

The third means includes a first support member which makes contact with the inclined underside of the hub so as to allow the hub to reciprocate when the hub rotates, a second support member which is positioned opposite to the first support member and makes contact with an upper side of the hub so as to reciprocate together with the hub when the hub rotates, and an elastic member disposed on the second support member, for returning the hub to an initial position thereof.

The inclined underside of the hub faces the motor, and the first support member includes a first support bar fixed to an outside of the motor and a first roller which is rotatably coupled to the first support bar and makes contact with the inclined underside of the hub. The second support member includes a second support which is fixed to a surface of the body forming the chilled air passage and on which the elastic member is installed, and a second roller which is rotatably coupled to the second support bar and makes contact with the upper surface of the hub.

The surface of the body forming the chilled air passage is provided with a guide member. The guide member is connected to the second support bar so as to allow the second support member to linearly reciprocate together with the hub when the hub linearly reciprocates, and so as to allow the elastic member to be continuously compressed and expanded.

Each heat exchange pin includes a band disposed around the refrigerant pipe and a plurality of ribbons which are radially formed around a circumference of the band.

The fan is repeatedly moved toward and away from the evaporator, so the blowing force applied to the evaporator varies, thereby generating a turbulent flow. Accordingly, the heat boundary layer is not formed on the evaporator, so the heat exchange efficiency is improved.

BRIEF DESCRIPTION OF THE DRAWINGS

The above object and other advantages of the present invention will become more apparent by describing in detail a preferred embodiment with reference to the attached drawings, in which.

DESCRIPTION OF THE PREFERRED EMBODIMENT

Hereinafter, a preferred embodiment of the present invention will be described in detail with reference to the accompanying drawings.

Figure 1:
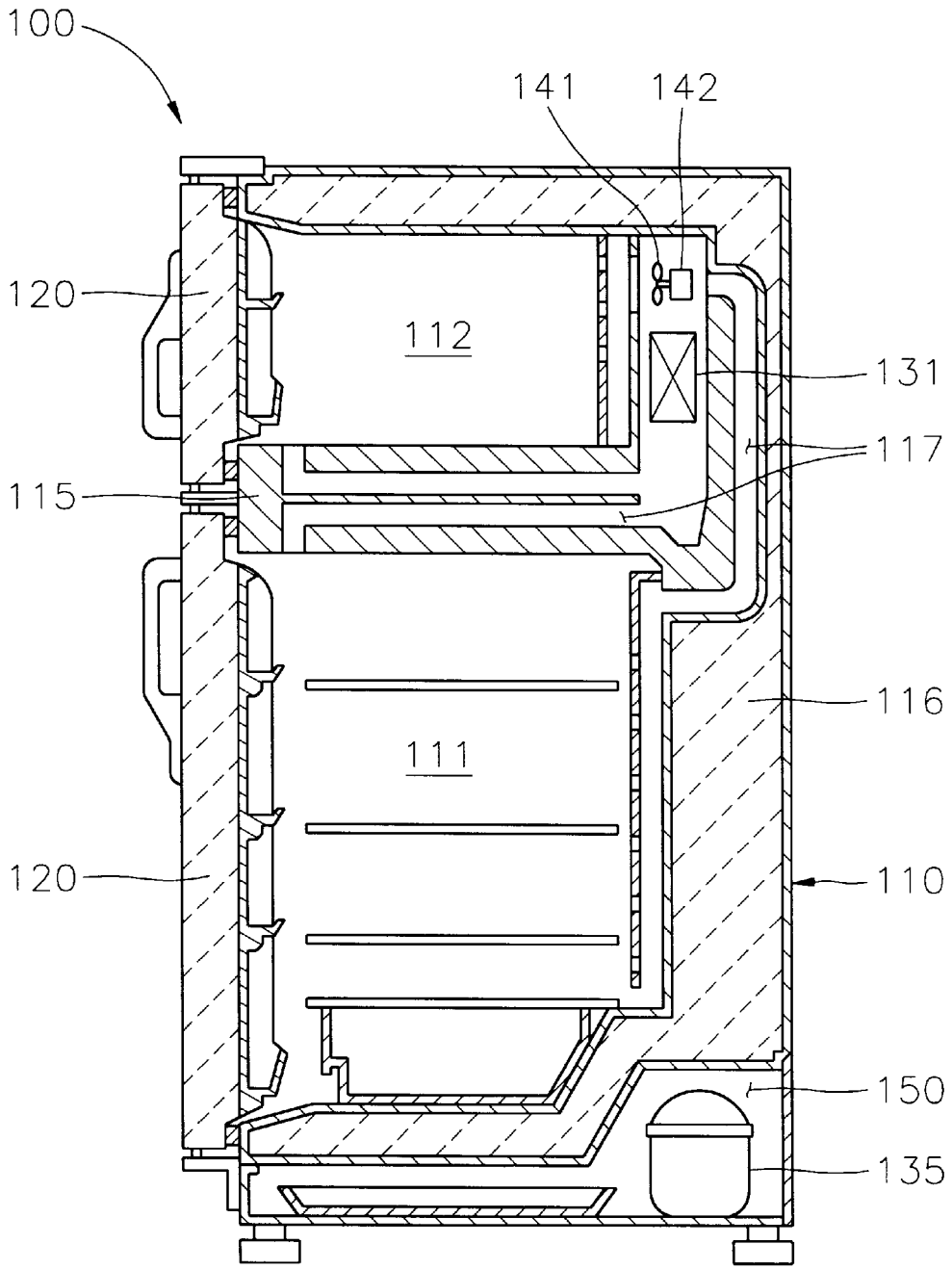
FIG. 1 (PRIOR ART)
FIG. 1 is a side sectional view showing a fan of a conventional refrigerator.
Figure 2:
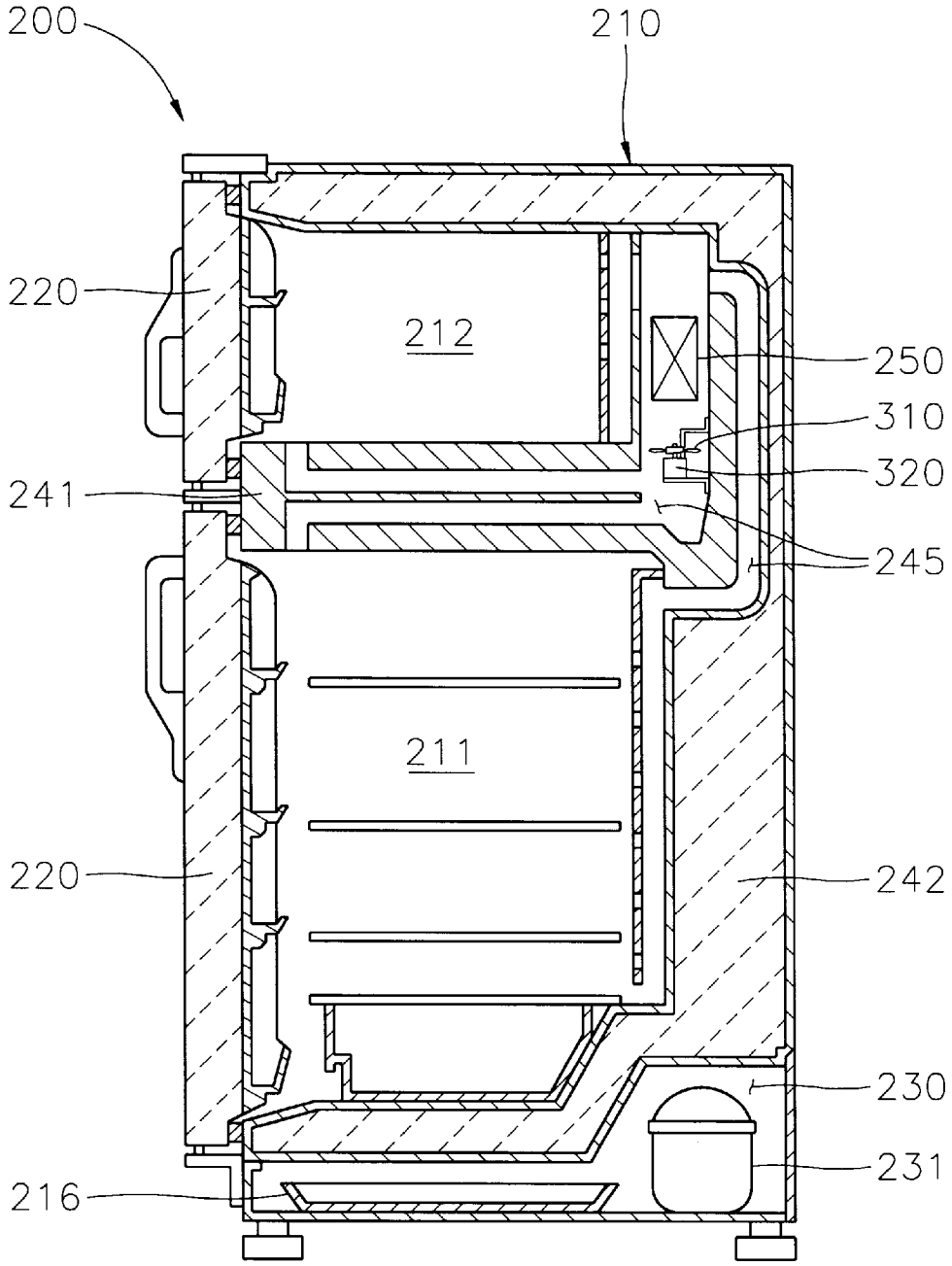
FIG. 2 is a side sectional view of a refrigerator according to one embodiment of the present invention.

FIG. 2 shows a side sectional view of a refrigerator 200 according to one embodiment of the present invention. As shown in FIG. 2, refrigerator 200 comprises a body 210 having a refrigerating chamber 211 and a freezing chamber 212 which are separated from each other, and a door 220 hingedly coupled to a front of body 210. A machine room 230 is provided at a lower portion of body 210, and both a compressor 231 and a condenser (not shown) are installed in machine room 230.

In addition, a chilled air passage 245 communicated with both refrigerating chamber 211 and freezing chamber 212 is formed in both a partition wall 241 which separates refrigerating chamber 211 from freezing chamber 212 and a rear wall 242 of body 210. In chilled air passage 245, there are installed an evaporator 250 which receives a refrigerant from the condenser so as to make a heat-exchange with an air, a fan 310 for blowing air towards evaporator 250, and a motor 320 for driving fan 310. Fan 310 circulates chilled air into refrigerating chamber 211 and freezing chamber 212 through ducts. Reference numeral 216 indicates a defrosted water box.

By the evaporator of the present invention, a heat-exchange area between air and the evaporator is widely formed, so the heat-exchange efficiency is improved. Hereinafter, the structure of the evaporator of the present invention will be explained with reference to FIG. 3.

Figure 3:
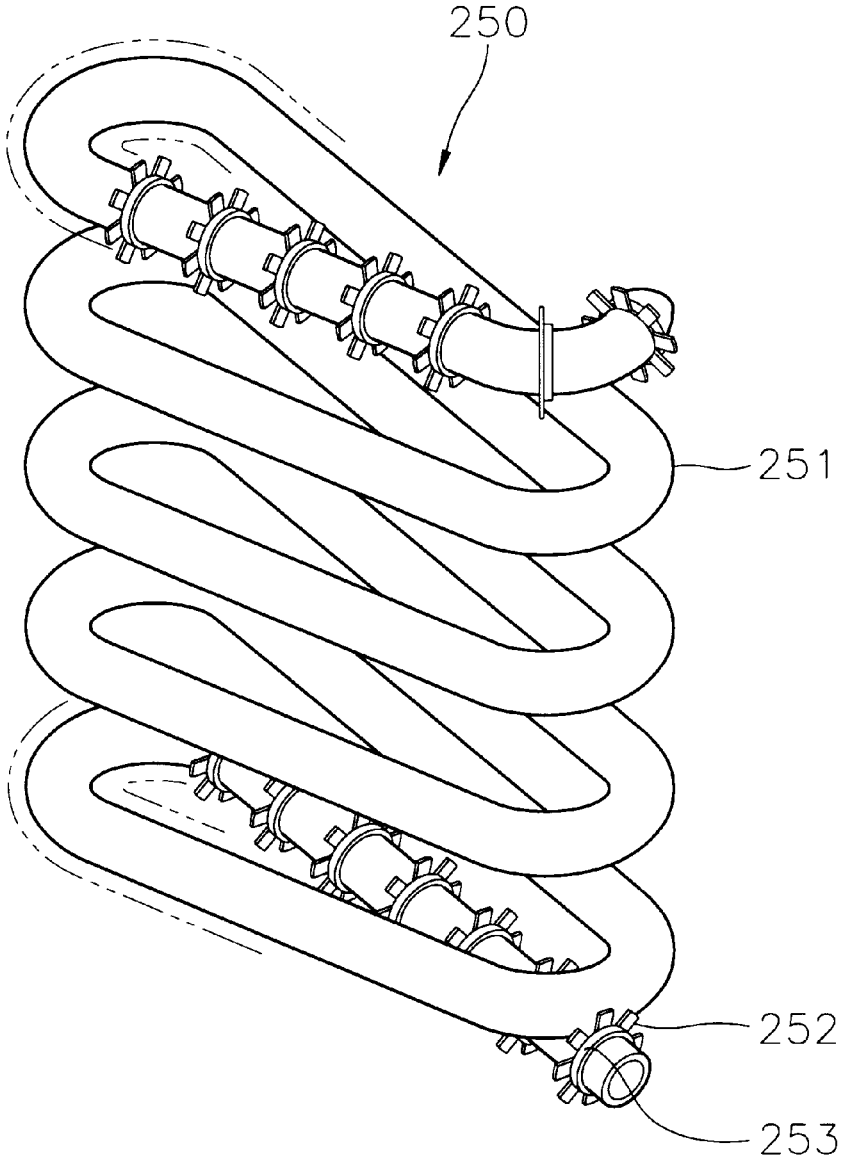
FIG. 3 is a perspective view showing an evaporator according to one embodiment of the present invention.

FIG. 3 is a perspective view showing evaporator 250 according to one embodiment of the present invention. Evaporator 250 includes a refrigerant pipe 251 into which the refrigerant flows, a plurality of bands 253 disposed around refrigerant pipe 251, and a plurality of ribbons 252 integrally formed at one side of each band 253. Refrigerant pipe 251 is wound in a spiral shape along a longitudinal direction of chilled air passage 245, and the refrigerant having a low-pressure and a low-temperature transferred from the condenser flows through refrigerant pipe 251. By the spiral shape of refrigerant pipe 251, the heat-exchange area between refrigerant pipe 251 and the air is increased. Ribbons 252 receives a heat from refrigerant pipe 251 and then makes a heat-exchange with the air, thereby further increasing the heat-exchange area.

Fan 310 according to the present invention can be reciprocated toward evaporator 250 while continuing its rotation, thereby generating a turbulent air flow. Accordingly, the blowing force applied to evaporator 250 varies so that the heat boundary layer, which is formed on evaporator 250 and caused by a constant air blowing from the fan thereby reducing the heat exchange efficiency between evaporator 250 and the air, can be prevented.

Figure 4:
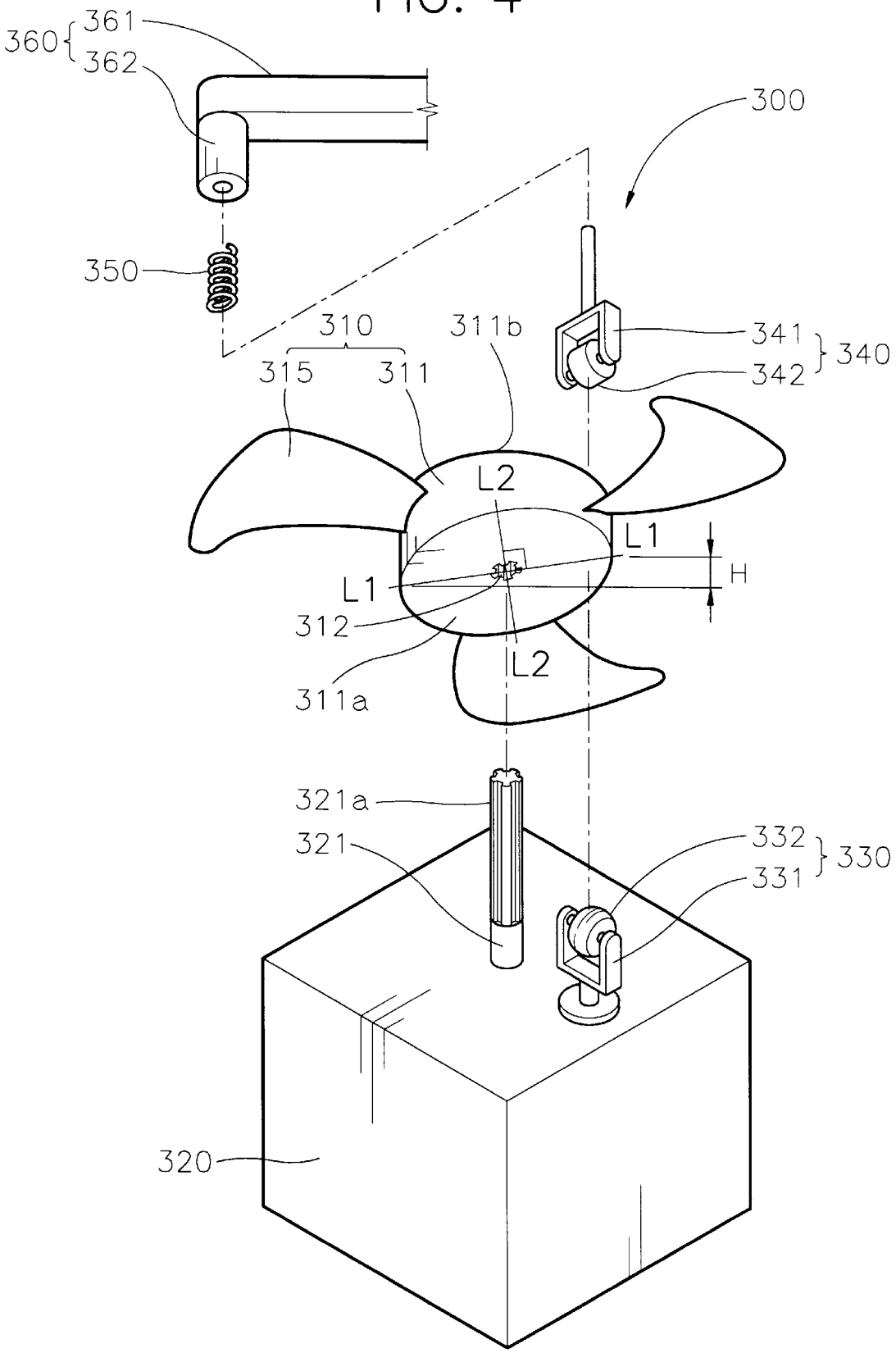
FIG. 4 is a perspective view showing a fan according to one embodiment of the present invention.

FIG. 4 shows a perspective view of fan 310 according to one embodiment of the present invention. As shown in FIG. 4, fan 310 is rotated by motor 320. Fan 310 includes a hub 311 rotated by a shaft 321 of motor 320 and a plurality of blades 315 integrally provided with a circumference of hub 311. A splined hole 312 is formed at a center of hub 311 and a spline 321*a* is formed in shaft 321 of motor 320 so as to be inserted into splined hole 312. At this time, hub 311 is coupled to shaft 321 of motor 320 in such a manner that it can reciprocate along shaft 321. Blades 315 rotate in the same direction as hub 311 and blow air toward shaft 321 of motor 320.

When hub 311 is coupled to shaft 321 of motor 320, an underside 311*a* of hub 311 which faces motor 320 is inclined. More detailedly, when a line L1-L2 passing through a center of hub 311 is drawn on underside of hub 311, a minimum thickness of hub 311 is determined at an one end of line L2-L2, and a maximum thickness of hub 311 is determined at the other end of line L1-L2. In addition, if inclined surface 311*a* has a circular shape, inclined surface 311*a* is symmetrized about a line L2-L2 which passes through the center of hub 311 and crosses line L1-L2 at a right angle. Installed between inclined surface 311*a* of hub 311 and motor 320 is a first support member 330 which not only supports hub 311, but also allows hub 311 to linearly reciprocate.

First support member 330 has a first support bar 331 fixed to an outside of motor 320, and a first roller 332 which is rotatably coupled to first support bar 331 and makes contact with inclined surface 311*a*. Inclined surface 311*a* of hub 311 makes contact with first roller 332 of first support member 330, and first support member 330 is fixed to motor 320. Accordingly, when hub 311 is rotated by motor 320, hub 311 continuously moves up and down in the range of a distance H which indicates a thickness difference of inclined surface 311*a*. Since hub 311 moves up and down, fan 310 also moves up and down while it blows air toward evaporator 250.

In addition, a second support member 340, which is linearly reciprocated together with hub 311 so as to allow hub 311 to stably rotate, is provided on an upper surface 311*b* of hub 311.

Second support member 340 includes a second support bar 341 fixed to a wall of body 210 forming chilled air passage 245, and a second roller 342 which is rotatably coupled to second support bar 341 and makes contact with upper surface 311*b* of hub 311. Second support member 340 faces first roller 332 so as to stably rotate hub 311 by first roller 332 and second roller 342.

Second support bar 341 is provided with an elastic member 350, such as a spring, which is repeatedly compressed and expanded in accordance with the reciprocating movement of hub 311 so as to return hub 311 to its initial position. When hub 311 is reciprocated, elastic member 350 does not carry out the reciprocating movement.

In order to support elastic member 350, a guide member 360 is provided. Guide member 360 has a fixing bar 361 fixed to the wall of body 210 forming chilled air passage 245, and a guide cylinder 362 which extends from an end of fixing bar 361 and into which second support bar 341 is inserted. Second support bar 341 of second support member 340 is reciprocated in guide cylinder 362. At this time, elastic member 350 makes contact with an underside of guide cylinder 362, so elastic member 350 is not inserted into guide cylinder 362. As a result, both hub 311 and second support member 340 are linearly reciprocated and elastic member 350 repeats its up and down movement.

Hereinafter, the operation of the refrigerator having the above construction is explained with reference to FIG. 5. FIGS. 5A and 5B are operational views for illustrating a reciprocating movement of fan 310 according to the present invention.

Figure 5A:
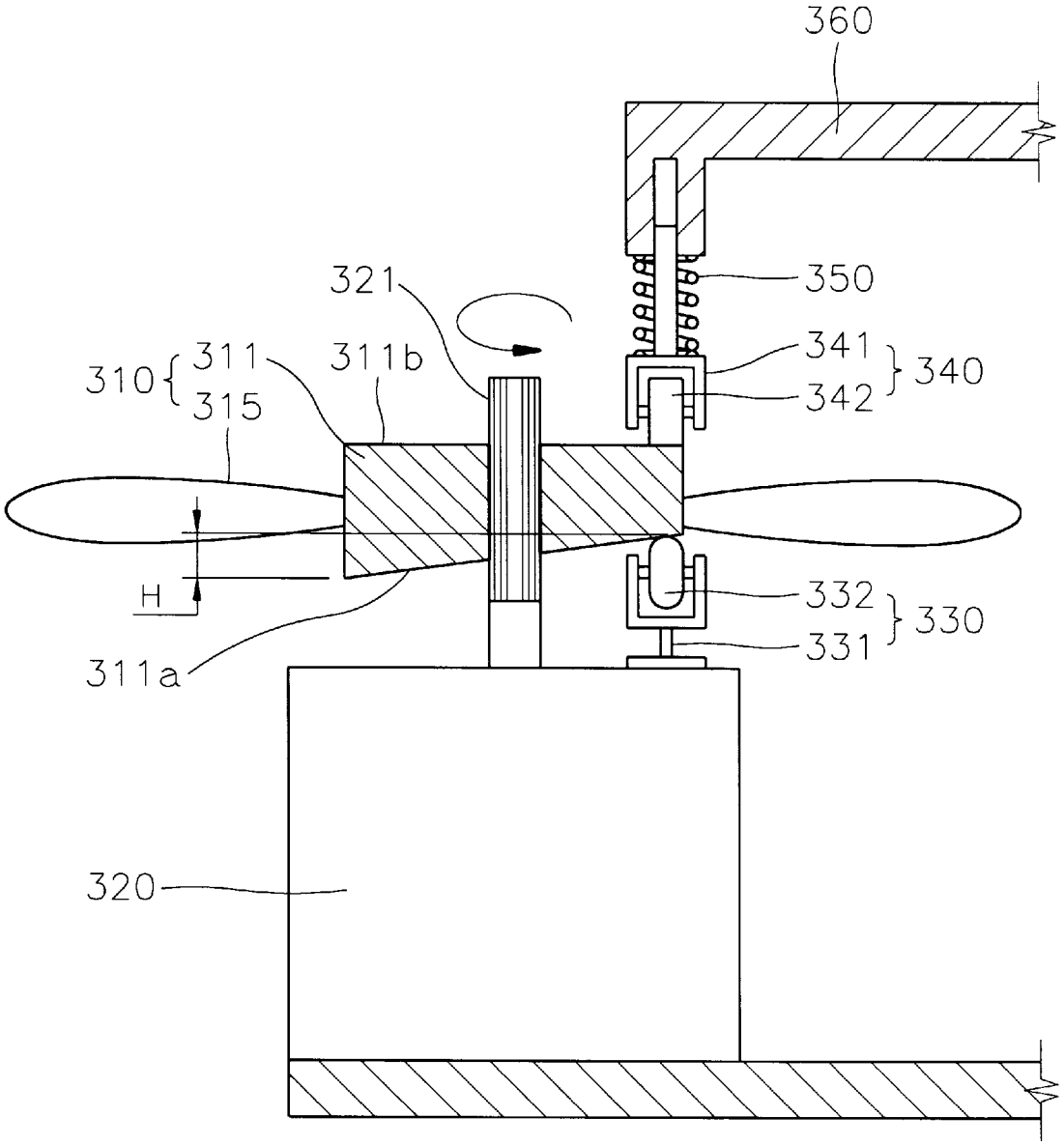
FIGS. 5A and 5B are operational views for illustrating a reciprocating movement of a fan according to one embodiment of the present invention.
Figure 5B:
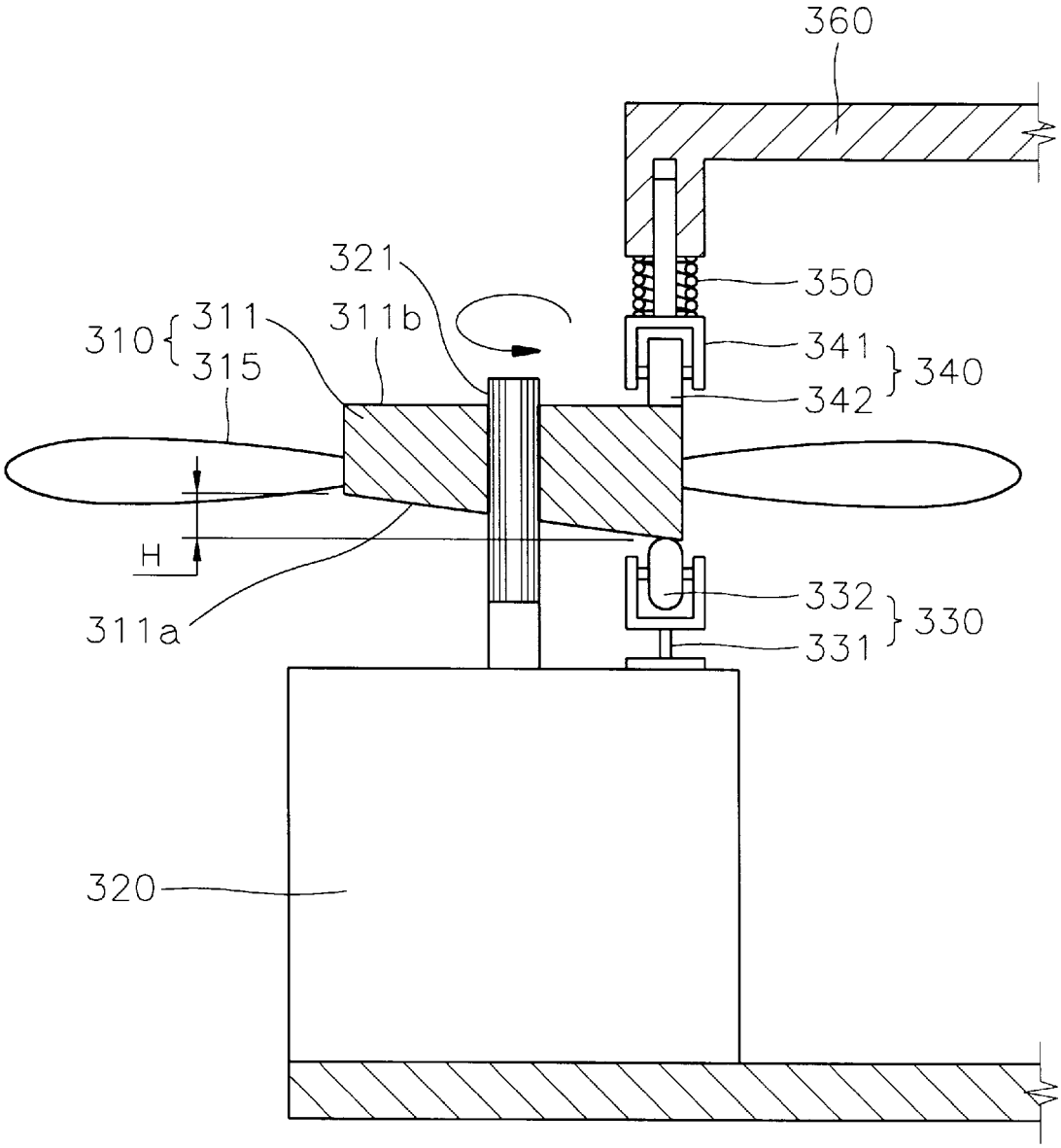

FIG. 5 shows first roller 332 of first support member 330 which makes contact with inclined surface 311*a* of hub 311 when inclined surface 311*a* is in its minimum thickness position. In this state, if hub 311 is rotated by motor 320, first roller 332 of first support member 330 makes contact with inclined surface 311*a* of hub 311 as shown in FIG. 5B in which inclined surface 311*a* is in its maximum thickness position. At this time, since first support member 330 is fixed to motor 320, hub 311 is upwardly moved by a distance H. Accordingly, second support member 340 which makes contact with upper surface 311*b* of hub 311 is also upwardly moved. At this time, since elastic member 350 cannot upwardly move due to guide member 360, elastic member 350 is compressed. After that, if hub 311 further rotates from the position shown in FIG. 5B to the position shown in FIG. 5A, hub 311 is returned to its initial position by means of a restoring force of elastic member 350 and a weight of hub 311.

In this manner, fan 310 is repeatedly moved toward and away from evaporator 250. Movement distance H of fan 310 can be adjusted by providing a plurality of rollers having different diameters on first support member 330.

As described above, according to the refrigerator of the present invention, the fan is repeatedly moved toward and away from the evaporator, so the blowing force applied to the evaporator varies, thereby generating a turbulent flow. Accordingly, the heat boundary layer is not formed on the evaporator, so the heat exchange efficiency is improved.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A refrigerator comprising:

a body having a refrigerating chamber, a freezing chamber, and a chilled air passage which communicates with the refrigerating and freezing chambers;

an evaporator for generating a chilled air by heat-exchanging with an air, the evaporator having a spiral-shaped refrigerant pipe which is disposed in a longitudinal direction of the chilled air passage, and a plurality of heat exchange pins disposed around the spiral-shaped refrigerant pipe for increasing a heat exchange area between the air and the spiral-shaped refrigerant pipe;

a first means for blowing the air toward the evaporator and for circulating the chilled air into the refrigerating and freezing chambers, the first means being installed in the chilled air passage;

a second means for driving the first means; and a third means for reciprocating the first means towards the evaporator, a blowing force applied to the evaporator being varied by a reciprocating movement of the first means so that an air flow from the first means to the evaporator is changed to a turbulent air flow.

2. The refrigerator as claimed in claim 1, wherein the first means includes a fan and the second means includes a motor, the fan having a hub and blades integrally formed at a circumference of the hub, for blowing the air in an axis direction of the motor, the hub being rotatably coupled to a shaft of the motor in such a manner that the hub linearly moves along the shaft of the motor, the hub having an inclined underside.

3. The refrigerator as claimed in claim 2, wherein the third means includes a first support member which makes contact with the inclined underside of the hub so as to allow the hub to reciprocate when the hub rotates, a second support member which is positioned opposite to the first support member and makes contact with an upper side of the hub so as to reciprocate together with the hub when the hub rotates, and an elastic member disposed on the second support member, for returning the hub to an initial position thereof.

4. The refrigerator as claimed in claim 3, wherein the inclined underside of the hub faces the motor, the first support member includes a first support bar fixed to an outside of the motor and a first roller which is rotatably coupled to the first support bar and makes contact with the inclined underside of the hub, and the second support member includes a second support which is fixed to a surface of the body forming the chilled air passage and on which the elastic member is installed, and a second roller which is rotatably coupled to the second support bar and makes contact with the upper surface of the hub.

5. The refrigerator as claimed in claim 4, wherein the surface of the body forming the chilled air passage is provided with a guide member, the guide member being connected to the second support bar so as to allow the second support member to linearly reciprocate together with the hub when the hub linearly reciprocates, and so as to allow the elastic member to be continuously compressed and expanded.

6. The refrigerator as claimed in claim 1, wherein each heat exchange pin includes a band disposed around the refrigerant pipe and a plurality of ribbons which are radially formed around a circumference of the band.

7. A refrigerator comprising:

a body having a refrigerating chamber, a freezing chamber, and a chilled air passage which communicates with the refrigerating and freezing chambers;

an evaporator for generating a chilled air by heat-exchanging with an air, the evaporator having a spiral-shaped refrigerant pipe which is disposed in a longitudinal direction of the chilled air passage, and a plurality of heat exchange pins disposed around the spiral-shaped refrigerant pipe for increasing a heat exchange area between the air and the spiral-shaped refrigerant pipe, each heat exchange pin including a band disposed around the refrigerant pipe and a plurality of ribbons which are radially formed around a circumference of the band;

a motor fixed to a wall of the body, the wall forming the chilled air passage;

a fan for blowing the air toward the evaporator and for circulating the chilled air into the refrigerating and freezing chambers, the fan having a hub and blades integrally formed at a circumference of the hub, for blowing the air in an axis direction of the motor; and a means for reciprocating the fan towards the evaporator, a blowing force applied to the evaporator being varied by a reciprocating movement of the fan so that an air flow from the fan to the evaporator is changed to a turbulent air flow.

8. The refrigerator as claimed in claim 7, wherein the means for reciprocating the fan includes a first support member which makes contact with the inclined underside of the hub so as to allow the hub to reciprocate when the hub rotates, a second support member which is positioned opposite to the first support member and makes contact with an upper side of the hub so as to reciprocate together with the hub when the hub rotates, and an elastic member disposed on the second support member, for returning the hub to an initial position thereof.

9. The refrigerator as claimed in claim 8, wherein the inclined underside of the hub faces to the motor, the first support member includes a first support bar fixed to an outside of the motor and a first roller which is rotatably coupled to the first support bar and makes contact with the inclined underside of the hub, and the second support member includes a second support which is fixed to the wall of the body forming the chilled air passage and on which the elastic member is installed, and a second roller which is rotatably coupled to the second support bar and makes contact with the upper surface of the hub.

10. The refrigerator as claimed in claim 9, wherein the wall of the body forming the chilled air passage is provided with a guide member, the guide member being connected to the second support bar so as to allow the second support member to linearly reciprocate together with the hub when the hub linearly reciprocates, and so as to allow the elastic member to be continuously compressed and expanded.

* * * * *